United States Patent [19]

Hattori

[11] 4,216,647

[45] Aug. 12, 1980

[54] ELECTRONIC TIMEPIECE

[75] Inventor: Ichiro Hattori, Tokyo, Japan

[73] Assignee: Kabushiki Kaisha Daini Seikosha, Tokyo, Japan

[21] Appl. No.: 961,744

[22] Filed: Nov. 17, 1978

[30] Foreign Application Priority Data

Nov. 18, 1977 [JP] Japan ..... 52-138729

[51] Int. Cl.[2] ..... G04C 3/00; G04C 21/00; G04B 37/12

[52] U.S. Cl. ..... 368/245; 368/73; 368/250

[58] Field of Search ..... 58/19 R, 24 R, 32, 38 R, 58/57.5, 85.5, 152 R, 152 B; 340/279; 325/2 A, 2 TC, 6 TA, 100.1 C

[56] References Cited

U.S. PATENT DOCUMENTS

| | | | |
|---|---|---|---|
| 2,580,447 | 1/1952 | Lutz | 58/24 R |
| 4,063,410 | 12/1977 | Welling | 58/38 R |
| 4,093,944 | 6/1978 | Muncheryan | 340/279 |
| 4,144,706 | 3/1979 | Willis | 58/57.5 |

*Primary Examiner*—Vit W. Miska

*Attorney, Agent, or Firm*—Robert E. Burns; Emmanuel J. Lobato; Bruce L. Adams

[57] ABSTRACT

In an electronic alarm timepiece having an alarm accordance circuit for producing an alarm signal at a preset time in accordance with a time stored in a time memory circuit, an electromechanical acoustic transducer is provided having at least two mechanical resonant frequencies. One of the resonant frequencies is in the audible range and one of the resonant frequencies is in the ultrasonic range. The transducer is actuatable to produce an acoustic alarm in the audible range in response to the alarm signal and is selectively actuated to produce an acoustic output in the ultrasonic range for controlling devices external of the timepiece.

3 Claims, 7 Drawing Figures

ELECTRONIC TIMEPIECE

BACKGROUND OF THE INVENTION

This invention relates to an electronic timepiece, and more particularly to an electronic timepiece with alarm which is able to generate ultrasonic waves and control other machinery by using the ultrasonic waves.

Electronic timepieces using a quartz oscillator as a source of base oscillation have developed remarkably thanks to the progress in electronic techniques, especially in the techniques of large-scale integrated circuits, and various timepieces with multifunctions are completed as commodities products and they are now on the market. For example, a stop watch with a time display or a time counting function, a world timepiece which displays times in several cities in the world, a timepiece with a counter, a display of remaining time, an alarm, a calculation function, etc. are available.

However, even in these watches with various functions, they only have a time display function and operation or calculation systems, but they don't have the ability of controlling other machinery.

SUMMARY OF THE INVENTION

The main object of the invention is to eliminate the shortcomings of the prior art by using an electronic timepiece with alarm of conventional composition, this invention offers an electronic timepiece, of which an electro-mechanical acoustic transducer has more than two mechanical resonance systems, by which an audible acoustic frequency is used for time information and said electromechanical acoustic transducer is driven for controlling other machinery by using an ultrasonic frequency.

DETAILED DESCRIPTION OF THE INVENTION

Figure 1:
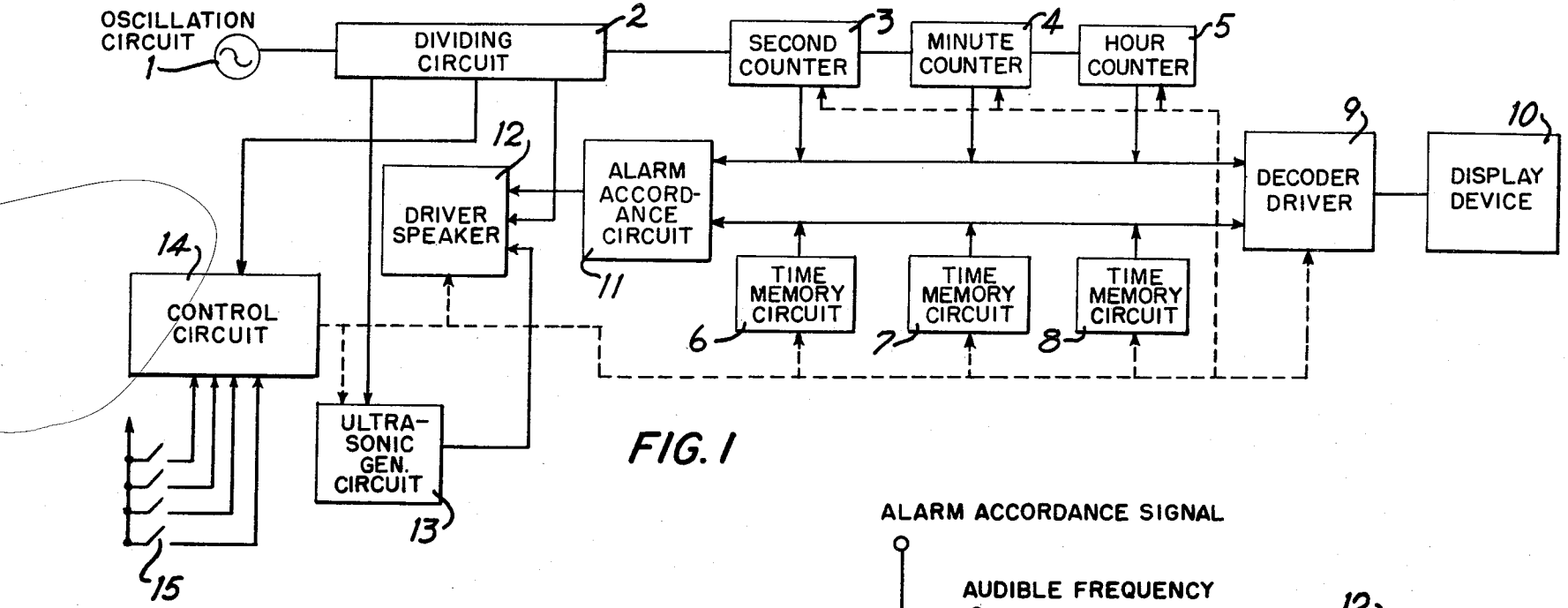
FIG. 1 is a block diagram of the present invention.

FIG. 1 shows a block diagram of an electronic timepiece according to this invention. Numeral 1 is an oscillation circuit, numeral 2 is a dividing circuit, numeral 3 is a second counter, numeral 4 is a minute counter, numeral 5 is an hour counter, numerals 6, 7, 8 are time memory circuits which memorize time information of second, minute, hour respectively. Information in the second, minute and hour counters 3,4,5 are respectively applied to a decoder-driver 9, of which an output is applied to a display device 10 and present time is displayed. At the same time, outputs of the alarm time memory circuits 6,7,8 are applied to an alarm accordance circuit 11, and are also applied to the decoder-driver and the alarm set time is displayed in a display device. When present time and alarm set time information which are applied in the alarm accordance circuit 11 are all in accordance, signals are produced so that an audible acoustic frequency (for example about 4 KHz) may be produced selectively from a driver-speaker 12.

To driver-speaker 12, the audible acoustic frequency, an ultrasonic wave frequency and an output of the alarm accordance circuit 11 are applied. Numeral 13 is an ultrasonic generating circuit which applies the ultrasonic wave frequency, for example more than 16 KHz, and encoded to forbid a malfunction of machinery controlled by the ultrasonic acoustic wave emitted from the driver-speaker, 12. Numeral 14 is a control circuit which receives information from a switch 15 and an output from the dividing circuit 2 and generates various control signals shown by dotted lines. For example, it produces selectively, a time revision signal and a unit-revision selection signal to alarm time memory circuits 6,7,8, a display signal to a decoder-driver, a control signal which encodes the ultrasonic signal to the ultrasonic generation circuit 13 at a, a ultrasonic frequency (for example more than 16 KHz) to a driver-speaker 12 and at the same time it generates a signal which inhibits the output of a frequency for alarm.

Figure 2:
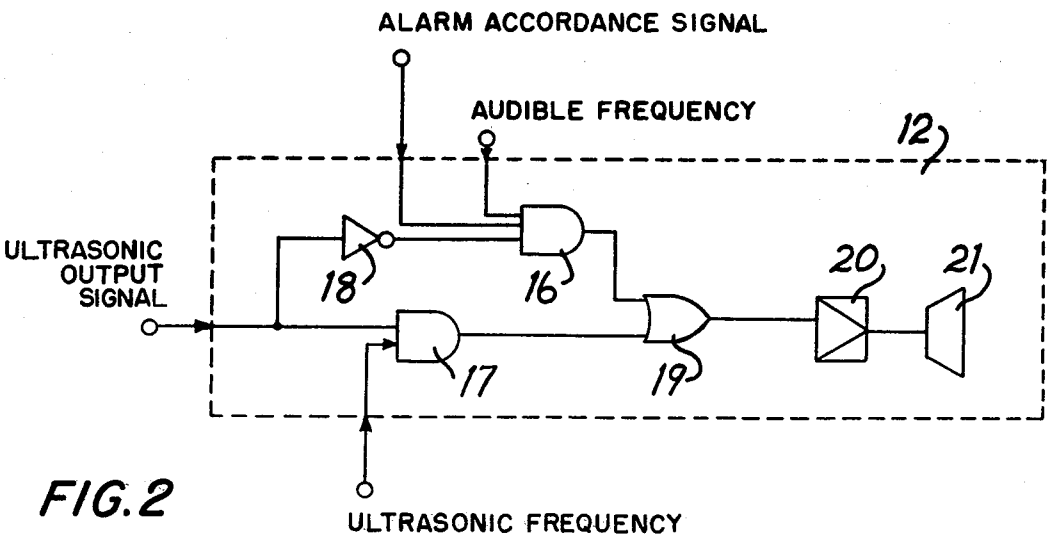
FIG. 2 is one example of a driver-speaker circuit of this invention.

FIG. 2 shows one embodiment of the driver-speaker 12, in which an alarm accordance signal, an audible frequency and an inverted ultrasonic wave output signal via inverter 18 are applied to AND gate 16, whose output is applied to OR gate 19.

The encoded ultrasonic wave frequency and the ultrasonic wave output signal are applied to AND gate 17, an output which is applied to another of OR gate 19, whose output is applied to a driver 20 and emitted out into the air via speaker 21. Referring next to the operation of such a construction, when an ultrasonic wave output signal is produced from said control circuit 14 as a "1" level signal, AND gate 17 opens and ultrasonic wave frequencies pass said AND gate and driver 20 and speaker 21, and become ultrasonic waves and are emitted out in the air via speaker 21. At this time AND gate 16 is disabled because of the inverted ultrasonic output signal which is applied via an inverter 18. Therefore, the audible frequency alarm cannot pass the gate 16 even if an alarm time is in accordance. When the ultrasonic wave output signal is at the "0" level, on the contrary, AND gate 16 opens and AND gate 17 is disabled, and if the alarm accordance signal is at the "1" level, the audible frequency passes the gate 16 and then passes driver 20 and speaker 21, and is emitted out into the air as an audible sound.

Figure 3:
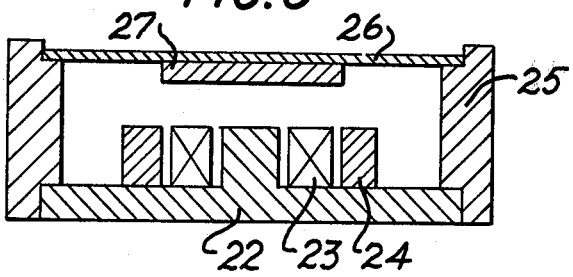
FIG. 3 is a sectional view of a speaker of this invention.

FIG. 3 shows a cross-sectional view of one embodiment of a speaker which enables this invention. Numeral 22 is a magnetic core with a center pole made of soft magnetic material, 23 is a coil, 24 is a magnet, 25 is a support body, 26 is an oscillation plate, 27 is pure iron made of soft magnetic material fixed on the oscillation plate 26.

In an electro-mechanical transducer thus comprised, by the flow of an alternative current in a coil 23, attraction or repulsion is operated in pure iron 27, by which an oscillation plate 26 is vibrated and generates a sound.

A basic resonance frequency fo-1 in the case of such composition, that is, where the periphery of the oscillation plate 26 is fixed, is known by the following formula:

$$fo-1=\frac{0.467}{r^2}\cdot t\sqrt{\frac{E}{\rho_o(1-\sigma^2)}}\ \text{(Hz)} \qquad (1)$$

in which r: a radius of the oscillation plate t: thickness of the oscillation plate $\sigma$: Poisson ratio of material used for the oscillation plate E: Young's modulus of material used for the oscillation plate P.: density of material used for the oscillation plate Generally, the frequency for an alarm of an electronic timepiece is 2048 Hz or 4096 Hz, therefore, by changing every parameter in a way that the basic resonance frequency fo-1 may become about these frequencies, an arbitrary frequency is obtained.

Further, in such an oscillation system, it is known that a higher order resonance frequency exists too.

In the structure according to this invention, a higher order resonance frequency fo-2, fo-3, shown in following formulas (2), (3), exists;

$$fo\text{-}2 = 3.91\ fo\text{-}1 \quad -(2)$$

$$fo\text{-}3 = 8.75\ fo\text{-}1 \quad -(3)$$

Figure 4A:
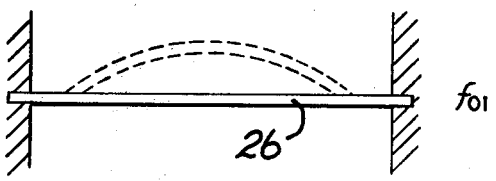
FIG. 4*a–c* are oscillation modes of an oscillation plate according to the invention.
Figure 4B:
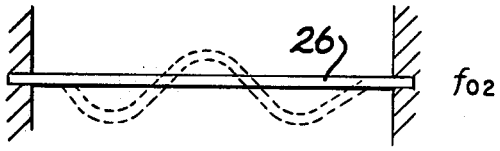
Figure 4C:
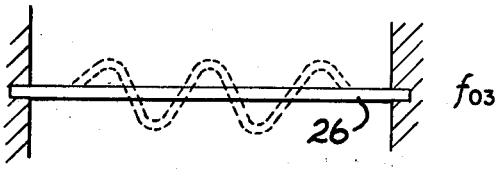

In FIG. 4 (*a*), vibration at the basic resonance frequency fo-1 is shown, similarly, FIG. 4 (*b*) shows fo-2 and FIG. 4 (*c*) shows at fo-3.

Figure 5:
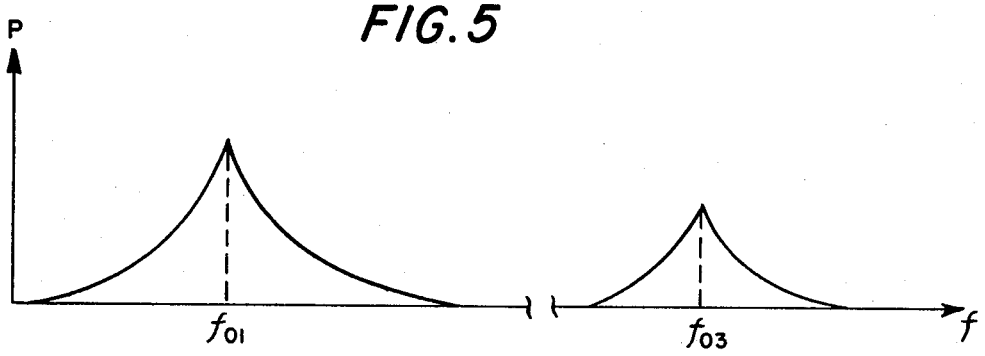
FIG. 5 is a characteristic of sound pressure-frequency of a speaker of this invention.

In the case where a generator of 32768 Hz is used as the source oscillation frequency, when 32768 Hz is used as the ultrasonic frequency, the basic resonance frequency fo-1 which is necessary as an audible acoustic wave frequency is 3.7 KHz according to the formula (3). When either the resonance frequency or the driving frequency is from about 100 Hz to about 200 Hz, a sound pressure which is sufficient to be used practically is obtained. And when resonance in a interior space of a timepiece is used, there is no problem, because resonance frequency is set lower than the driving frequency. Therefore, as is evident from description above, by driving a speaker using 4096 Hz as a perceptive acoustic wave frequency, setting the various parameters in the way that a basic resonance frequency at this moment may become about 4096 Hz, using 32768 Hz as an ultrasonic frequency, two kinds of sound, to wit, an audible acoustic wave and an ultrasonic wave are made from one electro-mechanical acoustic transducer, FIG. 5 shows the sound pressure characteristic, where the ordinates axis represents sound pressure, and the axis represents frequency.

As mentioned above, generation an audible acoustic wave and an ultrasonic wave using an alarm electronic timepiece is possible, and practical, its effect is great since the audible wave is an alarm sound as time information, and a ultrasonic wave used to control other machinery but time pieces such as doors, garages, illuminators and radios, T.V. etc. . . Further, technics of speaker fabrication of Integrated Circuit are applicated in this invention and LSI is used, so, miniaturization is possible. And this invention is not limited by said embodiment; for example, if an oscillation frequency is more than 32 KHz, appropriate frequency is choised by choosing fo-1 or fo-2 or fo-3.

And it goes without saying that the invention is realisable even if a display form of integrated circuit system will be changed.

I claim:

1. In an electronic alarm timepiece having an oscillator circuit for generating a high frequency output suitable as a time standard; a dividing circuit connected to the oscillator circuit for dividing the output thereof; a time counter receptive of the output of the dividing circuit for counting time; a settable time memory circuit and an alarm accordance circuit for detecting a coincidence between the count in the time counter and the time in the memory circuit; the improvement comprising an electro-mechanical acoustic transducer having at least two mechanical resonant frequencies wherein one is in the audible range and one is in the ultrasonic range; and alarm generating means for effecting the production of an alarm sound in the audible range in response to the detection of a coincidence by the alarm accordance circuit and for selectively effecting the production of an alarm in the ultrasonic range for controlling devices external of the timepiece.

2. In an electronic alarm timepiece having means for producing an alarm signal at a preset time, the improvement comprising: an electro-mechanical acoustic transducer having at least two mechanical resonant frequencies one of which is in the audible range and another of which is in the ultrasonic range; means for actuating the transducer to produce an acoustic alarm in the audible range in response to the alarm signal; and means for selectively actuating the transducer to produce an acoustic output in the ultrasonic range for controlling devices external of the timepiece.

3. The timepiece according to claim 2; wherein the selectively actuating means comprises a switch.

* * * * *